US006031460A

United States Patent [19]

Banks

[11] Patent Number: 6,031,460

[45] Date of Patent: Feb. 29, 2000

[54] CHILD LOCATING SYSTEM

[76] Inventor: Carlos D. Banks, 27 Canterberi Ct., Asheville, N.C. 28806

[21] Appl. No.: 08/839,474

[22] Filed: Apr. 14, 1997

[51] Int. Cl.[7] ..... G08B 23/00

[52] U.S. Cl. ..... 340/573; 340/573; 340/825.69; 340/538; 24/71 J; 58/23 BA

[58] Field of Search ..... 340/573, 555, 340/556, 557, 531, 329, 331, 435, 436, 825.36, 825.44, 825.49; 455/67.7, 70, 90, 97, 100, 101, 115, 128, 129; 429/96, 97, 98; D11/3, 27, 94; D10/32, 38

[56] References Cited

U.S. PATENT DOCUMENTS

| | | | |
|---|---|---|---|
| 3,913,182 | 10/1975 | Fontana | 24/71 J |
| 4,166,359 | 9/1979 | Domokos | 58/23 BA |
| 5,119,072 | 6/1992 | Hemingway | 340/573 |
| 5,210,532 | 5/1993 | Knoedler et al. | 340/825.69 |
| 5,298,883 | 3/1994 | Pilney et al. | 340/573 |
| 5,298,884 | 3/1994 | Gilmore et al. | 340/573 |
| 5,337,041 | 8/1994 | Friedman | 340/573 |
| 5,459,450 | 10/1995 | Beghelli | 340/538 |
| 5,525,967 | 6/1996 | Azizi et al. | 340/573 |

*Primary Examiner*—Jeffery A. Hofsass
*Assistant Examiner*—Toan N. Pham

[57] ABSTRACT

A child locating system including a metal bracelet. The bracelet has a circuitry compartment including a top face, a bottom face, and a periphery formed therebetween defining an interior space. The bracelet further includes a pair of metal straps with a first metal strap coupled at a first end thereof to a first side of the circuitry compartment and a second strap coupled at a first end thereof to a second side of the circuitry opposite the first side. A key actuateable locking mechanism is included for allowing the selective securement of the second end of the first strap and the second end of the second strap in a closed loop configuration about a wrist of a child. A first transceiver mechanism is situated within the interior space of the circuitry compartment and coupled to a power source. The first transceiver mechanism is adapted to deploy a recovery signal upon the receipt of an activation signal via free space. Also included is a second transceiver mechanism adapted to transmit the activation signal upon the activation thereof and further allow the receipt of the recovery signal for determining the location of the bracelet.

6 Claims, 3 Drawing Sheets

CHILD LOCATING SYSTEM

BACKGROUND OF THE INVENTION

1. Field of the Invention

The present invention relates to a child locating system and more particularly pertains to utilizing a specially adapted bracelet secured upon the wrist of a child for determining the location thereof.

2. Description of the Prior Art

The use of locating systems is known in the prior art. More specifically, locating systems heretofore devised and utilized for the purpose of locating objects are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,121,096 to Moore a position locating device that is self-powered and worn by a child or pet.

U.S. Pat. No. 5,119,072 to Hemingway discloses an apparatus for monitoring child activity including a transmitter having a microphone and oscillator coupled to an antenna within an enclosure for mounting on the child's arm.

U.S. Pat. No. Des. 345,314 to Chandra discloses the ornamental design for a combined transmitter and receiver for child monitoring.

U.S. Pat. No. 3,747,328 to Winkler; U.S. Pat. No. Des. 338,846 to Jewell; and U.S. Pat. No. Des. 321,329 to Barnett et al. are disclosed as being of general interest.

In this respect, the child locating system according to the present invention substantially departs from the conventional concepts and designs of the prior art, and in so doing provides an apparatus primarily developed for the purpose of utilizing a specially adapted bracelet secured upon the wrist of a child for determining the location thereof.

Therefore, it can be appreciated that there exists a continuing need for a new and improved child locating system which can be used for utilizing a specially adapted bracelet secured upon the wrist of a child for determining the location thereof. In this regard, the present invention substantially fulfills this need.

SUMMARY OF THE INVENTION

In view of the foregoing disadvantages inherent in the known types of locating systems now present in the prior art, the present invention provides an improved child locating system. As such, the general purpose of the present invention, which will be described subsequently in greater detail, is to provide a new and improved child locating system which has all the advantages of the prior art and none of the disadvantages.

To attain this, the present invention essentially comprises a metal bracelet. The bracelet has a rectangular circuitry compartment including a top face, a bottom face, and a periphery formed therebetween defining an interior space. A light emitting diode is situated on the top face which is adapted to emit light upon the actuation thereof. For allowing replacement of the power source, a battery cover is screwably coupled to the bottom face for allowing access to the interior space. As shown in FIG. 1, the bracelet further includes a pair of metal straps formed of a multiplicity of small rectangular portions. Each rectangular portion is hingably coupled together. A first metal strap is coupled at a first end thereof to a first side of the circuitry compartment. A second strap is coupled at a first end thereof to a second side of the circuitry opposite the first side. To afford coupling of the straps about a wrist of a user, a first locking component is integrally formed with a second end of the first metal strap. The first locking component includes a small tab with an arcuate cut out formed therein. A second locking component is integrally formed with a second end of the second metal strap and includes a key actuatable lock. The key actuatable lock is adapted to allow the selective securement of the second end of the first strap and the second end of the second strap in a closed loop configuration about a wrist of a child. As best shown in FIG. 6, a first transceiver mechanism is situated within the interior space of the circuitry compartment of the bracelet. The first transceiver mechanism is coupled to the power source and the light emitting diode of the bracelet. The first transceiver mechanism is also adapted to deploy an instantaneous recovery signal and actuate the light emitting diode upon the receipt of an instantaneous activation signal via free space. FIG. 5 shows a plastic hand held housing with a generally rectangular configuration. The plastic hand held housing has a front face, a rear face, a top face, a bottom face and a pair of side faces coupled therebetween thus defining an interior space. The hand held housing has a clip situated on the rear face thereof for allowing releasable coupling with a belt of a user. A light emitting diode is positioned on the top face thereof and is adapted to emit light upon the activation thereof. A key pad is situated on the front face of the housing with a plurality of keys associated therewith. A speaker is also located on the front face thereof for emitting an audible sound upon the actuation thereof. An activation button is situated on a side face thereof. Finally, a second transceiver mechanism is situated within the hand held housing. The second transceiver mechanism is coupled to the light emitting diode, the speaker, the keypad, and the activation button of the hand held housing. In use, the second transceiver mechanism is adapted to continuously transmit a plurality of instantaneous activation signals upon both the entering of a predetermined number of keypad keys in a predetermined order and further the depression of the activation key. The second transceiver mechanism is also adapted to determine a length of time between the transmission of the activation signal and a receipt of the recovery signal and further actuate the light emitting diode and speaker at rate that is a function of such length of time.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved child locating system which has all the advantages of the prior art locating systems and none of the disadvantages.

It is another object of the present invention to provide a new and improved child locating system which may be easily and efficiently manufactured and marketed.

It is a further object of the present invention to provide a new and improved child locating system which is of a durable and reliable construction.

An even further object of the present invention is to provide a new and improved child locating system which is susceptible of a low cost of manufacture with regard to both materials and labor, and which accordingly is then susceptible of low prices of sale to the consuming public, thereby making such child locating system economically available to the buying public.

Still yet another object of the present invention is to provide a new and improved child locating system which provides in the apparatuses and methods of the prior art some of the advantages thereof, while simultaneously overcoming some of the disadvantages normally associated therewith.

Still another object of the present invention is to utilize a specially adapted bracelet secured upon the wrist of a child for determining the location thereof.

Lastly, it is an object of the present invention to provide a new and improved child locating system including a metal bracelet. The bracelet has a circuitry compartment including a top face, a bottom face, and a periphery formed therebetween defining an interior space. The bracelet further includes a pair of metal straps with a first metal strap coupled at a first end thereof to a first side of the circuitry compartment and a second strap coupled at a first end thereof to a second side of the circuitry opposite the first side. A key actuateable locking mechanism is included for allowing the selective securement of the second end of the first strap and the second end of the second strap in a closed loop configuration about a wrist of a child. A first transceiver mechanism is situated within the interior space of the circuitry compartment and coupled to a power source. The first transceiver mechanism is adapted to deploy a recovery signal upon the receipt of an activation signal via free space. Also included is a second transceiver mechanism adapted to transmit the activation signal upon the activation thereof and further allow the receipt of the recovery signal for determining the location of the bracelet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
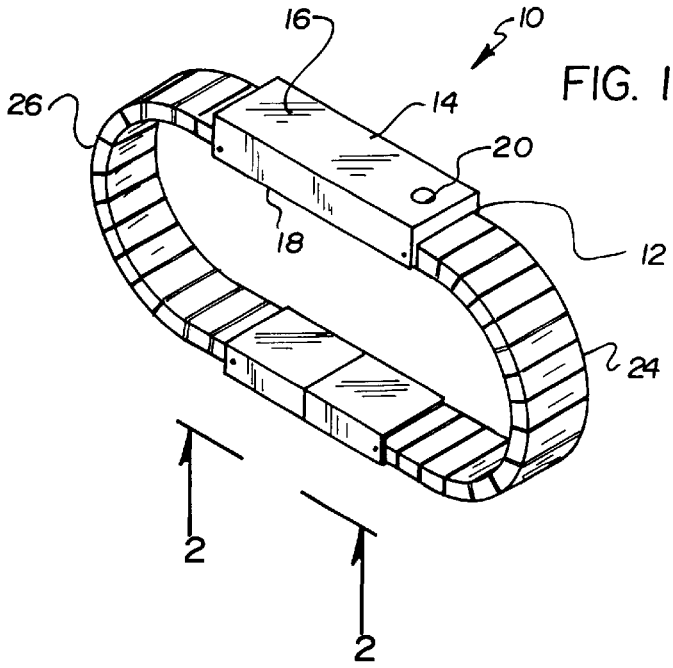
FIG. 1 is a perspective illustration of the preferred embodiment of the child locating system constructed in accordance with the principles of the present invention.
Figure 2:
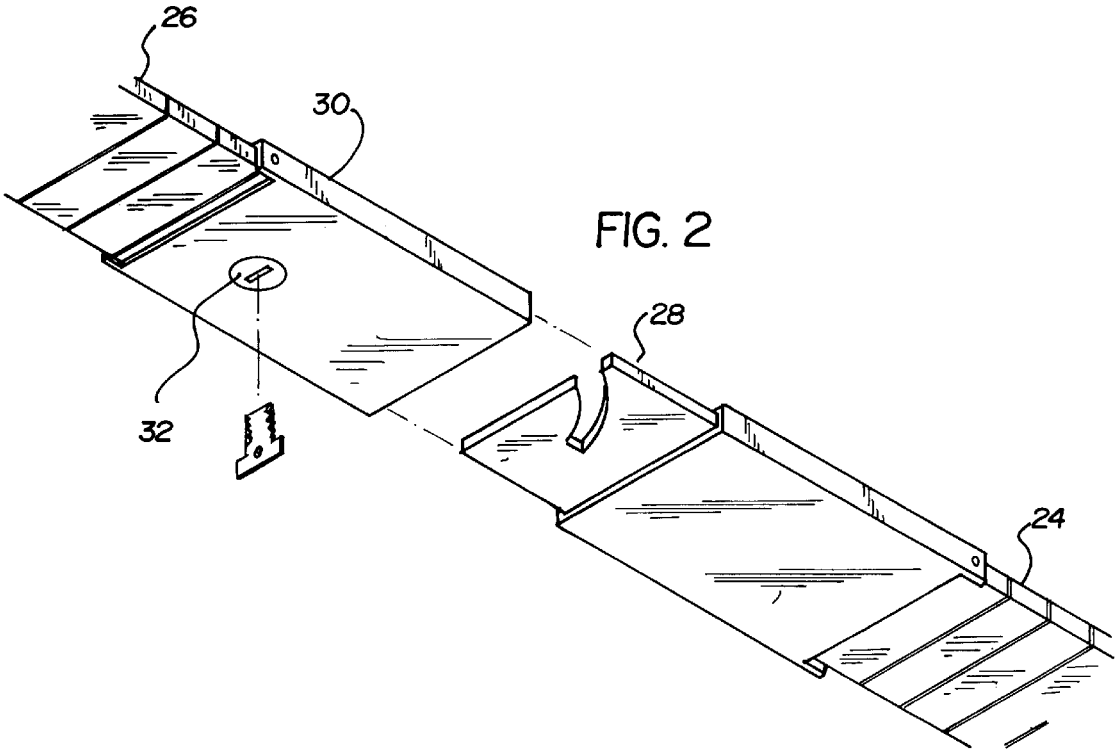
FIG. 2 is an exploded perspective view of the locking mechanism of the bracelet.
Figure 3:
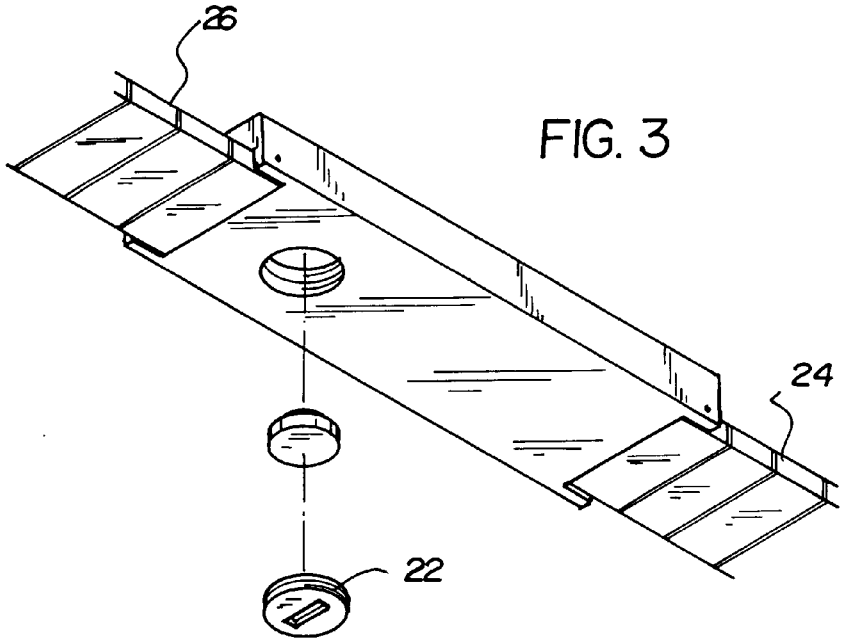
FIG. 3 is an exploded perspective view of the bottom face of the circuitry component of the bracelet.
Figure 4:
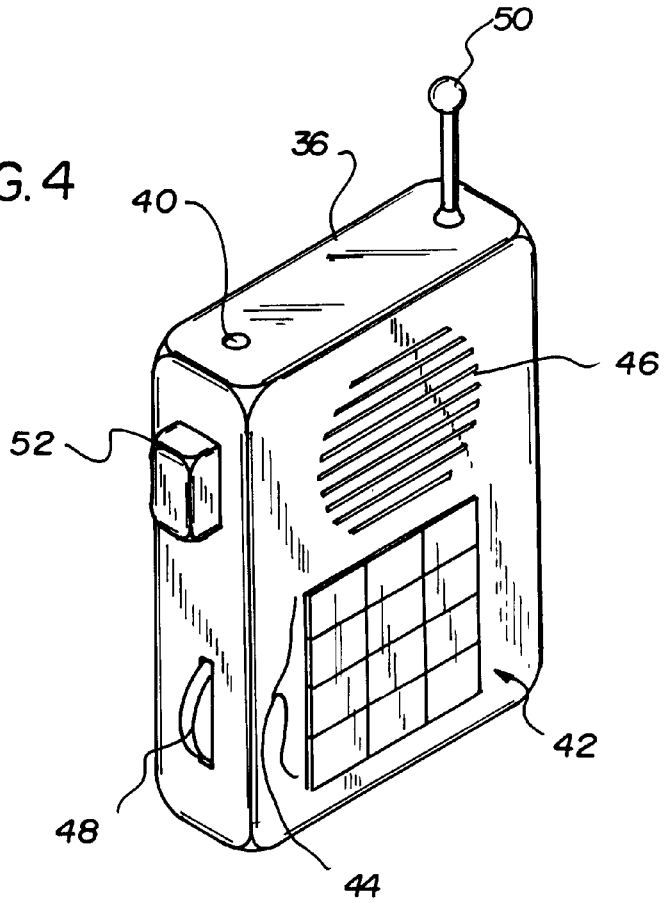
FIG. 4 is a perspective view of the front face of the hand held housing.

With reference now to the drawings, and in particular to FIG. 1 thereof, a new and improved child locating system embodying the principles and concepts of the present invention and generally designated by the reference numeral 10 will be described.

The present invention, the new and improved child locating system, is comprised of a plurality of components. Such components in their broadest context include a specially adapted bracelet, first transceiver, hand held housing, and second transceiver. Such components are individually configured and correlated with respect to each other so as to attain the desired objective.

More specifically, it will be noted that the system 10 of the present invention includes a metal bracelet 12. The bracelet has a rectangular circuitry compartment 14 including a top face 16, a bottom face 18, and a periphery formed therebetween defining an interior space. Preferably, indicia representative of the name and address of the wearer is imprinted on the top face of the circuitry compartment. Also, the circuitry compartment is both waterproof and fireproof. A light emitting diode 20 is situated on the top face which is adapted to emit light upon the actuation thereof. For allowing replacement of the power source, a battery cover 22 is screwably coupled to the bottom face for allowing access to the interior space. The placement of the battery cover precludes the removal of the battery when the bracelet is worn by a user. As shown in FIG. 1, the bracelet further includes a pair of metal straps formed of a multiplicity of small rectangular portions. Each rectangular portion is hingably coupled together. As such, the bracelet may not be removed by cutting the straps. A first metal strap 24 is coupled at a first end thereof to a first side of the circuitry compartment. A second strap 26 is coupled at a first end thereof to a second side of the circuitry opposite the first side. To afford coupling of the straps about a wrist of a user, a first locking component 28 is integrally formed with a second end of the first metal strap. The first locking component includes a small tab with an arcuate cut out formed therein. A second locking component 30 is integrally formed with a second end of the second metal strap and includes a key 32 actuatable lock. The key actuatable lock is adapted to allow the selective securement of the second end of the first strap and the second end of the second strap in a closed loop configuration about a wrist of a child. Ideally, a locking arm associated with the second locking component engages the arcuate cut out upon the locking of the locking mechanism.

Figure 6:
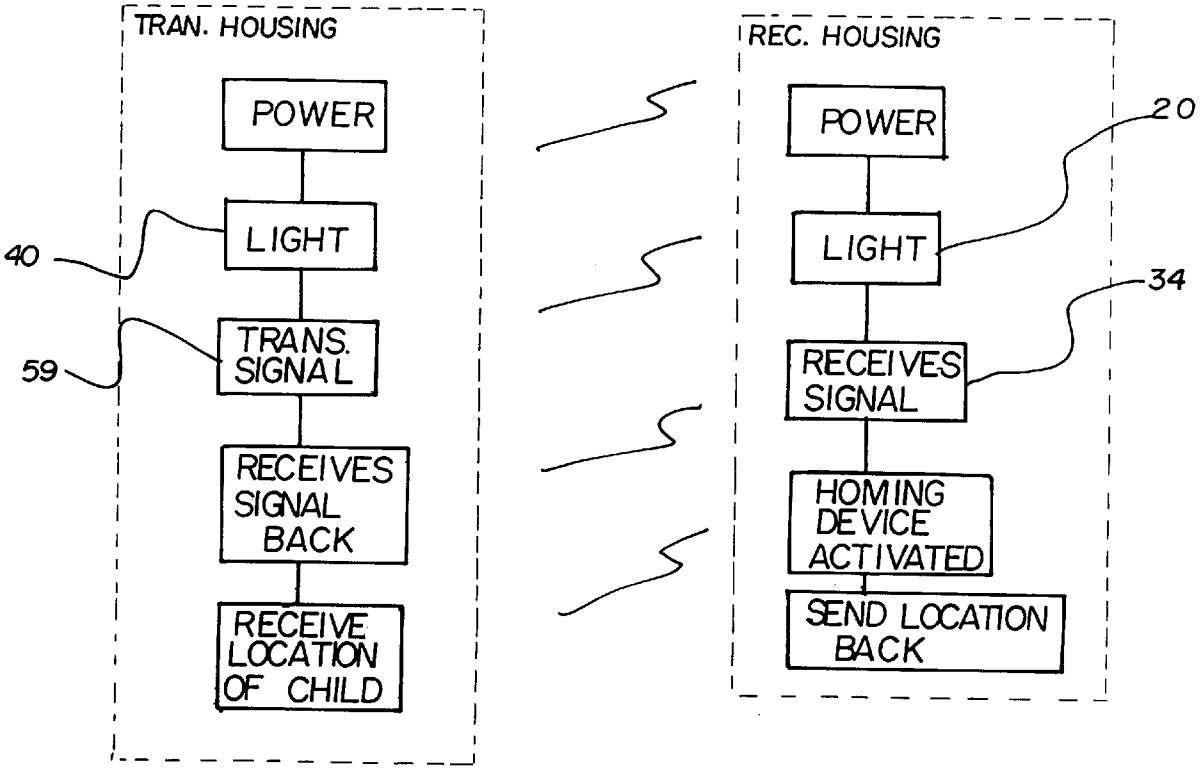
FIG. 6 is a schematic of the circuitry employed in the present invention.

As best shown in FIG. 6, a first transceiver mechanism 34 is situated within the interior space of the circuitry compartment of the bracelet. The first transceiver mechanism is coupled to the power source and the light emitting diode of the bracelet. The first transceiver mechanism is also adapted to deploy an instantaneous recovery signal and actuate the light emitting diode upon the receipt of an instantaneous activation signal via free space.

Figure 5:
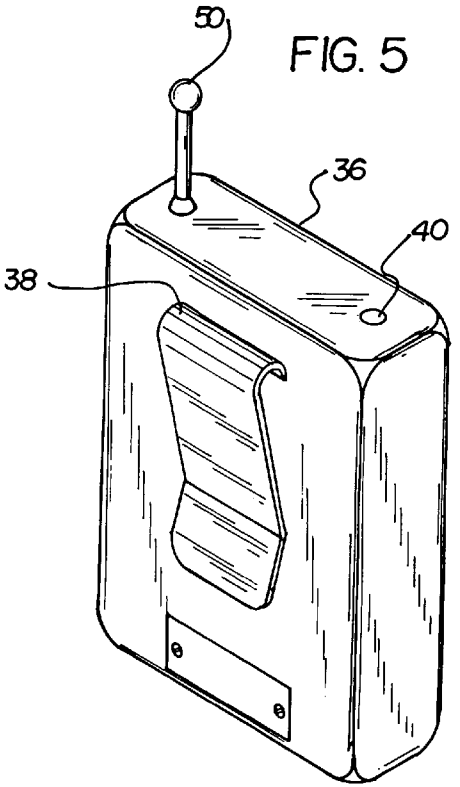
FIG. 5 is a perspective view of the rear face of the hand held housing.

FIG. 5 shows a plastic hand held housing 36 with a generally rectangular configuration. The plastic hand held housing has a front face, a rear face, a top face, a bottom face and a pair of side faces coupled therebetween thus defining an interior space. The hand held housing has a clip 38 situated on the rear face thereof for allowing releasable coupling with a belt of a user. A light emitting diode 40 is positioned on the top face thereof and is adapted to emit light upon the activation thereof. A key pad 42 is situated on the front face of the housing with a plurality of keys 44 associated therewith. A speaker 46 is also located on the front face thereof for emitting an audible sound upon the actuation thereof. A volume control dial 48 is associated with the speaker for controlling the strength of the audible sound emitted therefrom. For facilitating the receipt and transmission of signals, a retractable antenna 50 is situated on the top face of the housing. An activation button 52 is situated on a side face thereof.

Finally, a second transceiver mechanism 54 is situated within the hand held housing. The second transceiver mechanism is coupled to the light emitting diode, the speaker, the keypad, the antenna, and the activation button of the hand held housing. In use, the second transceiver mechanism is adapted to continuously transmit a plurality of instantaneous activation signals upon both the entering of a predetermined number of keypad keys in a predetermined order and further the depression of the activation key. Preferably, such sequence consists of a 3 digit number which precludes an unauthorized person from tracking the bracelet. The second transceiver mechanism is also adapted to determine a length of time between the transmission of the activation signal and a receipt of the recovery signal and further actuate the light emitting diode and speaker at rate that is a function of said length of time. Ideally, the rate of actuation of the speaker and light emitting diode increases as the aforementioned length of time decreases.

In an alternate embodiment, a GPS system may be employed in lieu of the first transceiver. In such an embodiment, the recovery signal consists of the instant coordinates of the bracelet. Also, a paging signal may be employed to activate the bracelet. It should be further noted that other types of jewelry capable of being securely fastened to a child's body may be employed in lieu of the bracelet.

In use, the bracelet is secured to a wrist of a child by a parent and the hand held housing remains with the guardian. Upon the child becoming lost, the activation button of the hand held housing may be depressed. At such time, the light emitting diode of the bracelet emits light thus signalling to the child that the guardian is seeking him or her. Also the first transceiver mechanism emits a recovery signal after every receipt of the activation signal. The guardian may then use the rate of actuation of the speaker and the light emitting diode of the hand held housing to determine the location of the child.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved child locating system comprising, in combination:

a metal bracelet having a rectangular circuitry compartment including a top face, a bottom face, and a periphery formed therebetween defining an interior space with a light emitting diode situated on the top face which is adapted to emit light upon the actuation thereof and a battery cover screwably coupled to the bottom face for allowing access therein, the bracelet further including a pair of metal straps formed of a multiplicity of small rectangular portions hingably coupled together with a first metal strap coupled at a first end thereof to a first side of the circuitry compartment and a second strap coupled at a first end thereof to a second side of the circuitry opposite the first side, wherein a first locking component is integrally formed with a second end of the first metal strap including a small tab with an arcuate cut out formed therein and a second locking component is integrally formed with a second end of the second metal strap including a key actuatable lock adapted to allow the selective securement of the second end of the first strap and the second end of the second strap in a closed loop configuration about a wrist of a child;

power means removably situated within the interior space of the circuitry compartment via the battery cover;

first transceiver means situated within the interior space of the circuitry compartment and coupled to the transceiver power means and the light emitting diode, the transceiver means adapted to deploy an instantaneous recovery signal and actuate the light emitting diode upon the receipt of an instantaneous activation signal via free space;

a plastic hand held housing with a generally rectangular configuration having a front face, a rear face, a top face, a bottom face and a pair of side faces coupled therebetween thus defining an interior space, the hand held housing having a clip situated on the rear face thereof for allowing releasable coupling with a belt of a user, a light emitting diode positioned on the top face thereof and adapted to emit light upon the activation thereof, a key pad situated on the front face of the housing with a plurality of keys, a speaker also located on the front face thereof for emitting an audible sound upon the actuation thereof, and an activation button situated on a side face thereof; and second transceiver means situated within the hand held housing and coupled to the light emitting diode, the speaker, the keypad, and the activation button of the hand held housing, the second transceiver means adapted to continuously transmit a plurality of instantaneous activation signals upon both the entering of a predetermined number of keypad keys in a predetermined order and further the depression of the activation key, the second transceiver means also adapted to determine a length of time between the transmission of the activation signal and a receipt of the recovery signal and further actuate the light emitting diode and speaker at rate that is a function of said length of time.

2. A child locating system comprising:

a metal bracelet having a circuitry compartment including a top face, a bottom face, and a periphery formed therebetween defining an interior space, the bracelet further including a pair of metal straps with a first metal strap coupled at a first end thereof to a first side of the circuitry compartment and a second strap coupled at a first end thereof to a second side of the circuitry opposite the first side, wherein a key actuateable locking mechanism is included for the selective securement of the second end of the first strap and the second end of the second strap in a closed loop configuration about a wrist of a child;

first transceiver means situated within the interior space of the circuitry compartment and coupled to a power source, the transceiver means adapted to deploy a recovery signal upon the receipt of an activation signal via free space; and second transceiver means adapted to transmit the activation signal upon the activation thereof and further allow the receipt of the recovery signal for determining the location of the bracelets;

wherein the hand held housing further has a keypad with associated keys positioned thereon with the second transceiver means further adapted to continuously transmit a plurality of instantaneous activation signals only upon the entering of a predetermined number of keypad keys in a predetermined order for precluding unauthorized persons from tracking the bracelet;

wherein the locking mechanism comprises a small tab situated on the second end of the first strap with an arcuate cut out formed therein and a second locking component is integrally formed with a second end of the second metal strap including a key actuateable lock.

3. A child locating system as set forth in claim 2 wherein the second transceiver resides in a hand held housing with a light emitting diode positioned on the top face thereof with the light emitting diode adapted to emit light upon the activation thereof and an activation button situated on a side face thereof with the second receiver means coupled to the light emitting diode and the activation button of the hand held housing, wherein the second transceiver means is adapted to continuously transmit a plurality of instantaneous activation signals upon the depression of the activation key, the second transceiver means also adapted to determine a length of time between the transmission of the activation signal and a receipt of the recovery signal and further actuate the light emitting diode at rate that is a function of said length of time.

4. A child locating system as set forth in claim 2 wherein the bracelet further has a light emitting diode situated thereon which is adapted to emit light upon the receipt of the activation signal.

5. A child locating system as set forth in claim 2 wherein the bracelet further has a battery cover screwably coupled to the bottom face thereof for allowing access therein.

6. A child locating system as set forth in claim 2 wherein the straps of the bracelet are formed of a multiplicity of small rectangular portions hingably coupled together.

* * * * *